US007507100B2

(12) United States Patent
Malkin et al.

(10) Patent No.: US 7,507,100 B2
(45) Date of Patent: Mar. 24, 2009

(54) METHOD AND APPARATUS AND METHOD FOR CONNECTING A FIRST FLAT CONDUCTOR WITH A SECOND CONDUCTOR

(75) Inventors: Matthew C. Malkin, Seattle, WA (US); Xinlin Peter Qing, Cupertino, CA (US)

(73) Assignee: Boeing Company, Chicago, IL (US)

( * ) Notice: Subject to any disclaimer, the term of this patent is extended or adjusted under 35 U.S.C. 154(b) by 0 days.

(21) Appl. No.: 11/759,794

(22) Filed: Jun. 7, 2007

(65) Prior Publication Data

US 2008/0305652 A1 Dec. 11, 2008

(51) Int. Cl.
*H01R 13/62* (2006.01)

(52) U.S. Cl. ..... 439/329; 439/493

(58) Field of Classification Search ..... 439/329, 439/493

See application file for complete search history.

(56) References Cited

U.S. PATENT DOCUMENTS 3,794,953 A * 2/1974 Malin ..... 439/329
4,913,656 A * 4/1990 Gordon et al. ..... 439/67
5,051,366 A * 9/1991 Anderson et al. ..... 436/67
5,092,781 A * 3/1992 Casciotti et al. ..... 439/62
5,171,154 A * 12/1992 Casciotti et al. ..... 439/67
5,730,619 A * 3/1998 Hamlin ..... 439/493
6,034,876 A * 3/2000 Ohno et al. ..... 361/752
6,508,660 B2 * 1/2003 Self ..... 439/374
6,520,789 B2 * 2/2003 Daugherty, Jr. et al. ..... 439/329
6,537,082 B2 * 3/2003 Hopfer, III et al. ..... 439/67
6,537,085 B2 * 3/2003 Na ..... 439/76.1
6,602,092 B2 * 8/2003 Soubh ..... 439/493
6,752,638 B2 * 6/2004 Na ..... 439/76.1
6,846,194 B2 * 1/2005 Self et al. ..... 439/329
6,932,621 B2 8/2005 Anderson et al.
6,939,144 B2 * 9/2005 Kuczynski et al. ..... 439/67
7,234,949 B2 * 6/2007 Koyasu ..... 439/76.1
2005/0118854 A1 * 6/2005 Lange et al. ..... 439/329
2008/0305652 A1 * 12/2008 Malkin et al. ..... 439/65

OTHER PUBLICATIONS

Web page: http://www.deutschdao.com/mil38999 ser3 composite pcb bxrtab.pdf; re: Deutch ECD Composite PCB Connectors; Deutsch ECD Engineered Connecting Devices; Hemet, CA.

* cited by examiner

*Primary Examiner*—James Harvey
(74) *Attorney, Agent, or Firm*—Law Office of Donald D. Mondul

(57) ABSTRACT

An apparatus for establishing a substantially unitary connecting structure including a generally flat conductor member carrying a first plurality of first electrical conductors and a second conductor member carrying a second plurality of second electrical conductors includes: (a) an electrical connecting structure configured for receiving the second conductor member to establish electrical connection between at least one first electrical conductor of the first plurality of first electrical conductors and at least one second electrical conductor of the second plurality of second electrical conductors; (b) a generally inflexible support structure; and (c) at least one connecting member traversing the flat conductor member and cooperating with the electrical connecting structure and the support structure for capturing the flat conductor member between the connecting structure and the support structure in an installed orientation.

20 Claims, 4 Drawing Sheets

110

10

210

METHOD AND APPARATUS AND METHOD FOR CONNECTING A FIRST FLAT CONDUCTOR WITH A SECOND CONDUCTOR

This invention was made with Government support under FA8650-04D-3446 awarded by the United States Air Force. The Government has certain rights in this invention.

TECHNICAL AREA

The present description may be directed to interconductor connectors, and especially to interconductor connectors configured for resisting physical separating forces.

BACKGROUND

Some electrical systems such as, by way of example and not by way of limitation, sensor systems with flat wire construction may require data cable connections. The data cables may be significantly larger and stiffer than the conducting elements of the flat wire sensor system. Mechanical loads applied to a data cable may be transmitted to the electrical connection between the data cable and the flat wire structure, thereby weakening the electrical connection.

There is a need for an apparatus and method for connecting a flat wire conductor with a second conductor such as a data cable without transmitting mechanical loads between the flat wire conductor and the second conductor.

SUMMARY

An apparatus for establishing a substantially unitary connecting structure including a generally flat conductor member carrying a first plurality of first electrical conductors and a second conductor member carrying a second plurality of second electrical conductors includes: (a) an electrical connecting structure configured for receiving the second conductor member to establish electrical connection between at least one first electrical conductor of the first plurality of first electrical conductors and at least one second electrical conductor of the second plurality of second electrical conductors; (b) a generally inflexible support structure; and (c) at least one connecting member traversing the flat conductor member and cooperating with the electrical connecting structure and the support structure for capturing the flat conductor member between the connecting structure and the support structure in an installed orientation.

A method for establishing a substantially unitary connecting structure including a generally flat conductor member carrying a first plurality of first electrical conductors and a second conductor member carrying a second plurality of second electrical conductors; includes: (a) in no particular order: (1) providing an electrical connecting structure configured for receiving the second conductor member to establish electrical connection between at least one first electrical conductor of the first plurality of first electrical conductors and at least one second electrical conductor of the second plurality of second electrical conductors; (2) providing a generally inflexible support structure; and (3) providing at least one connecting member; and (b) orienting the at least one connecting member to traverse the flat conductor member and to cooperate with the electrical connecting structure and the support structure to effect capturing the flat conductor member between the connecting structure and the support structure in an installed orientation.

It is, therefore, a feature of the described embodiment to provide an apparatus and method for connecting a flat wire conductor with a second conductor such as a data cable without transmitting mechanical loads between the flat wire conductor and the second conductor.

Further features of embodiments of the present invention may be apparent from the following specification and claims when considered in connection with the accompanying drawings, in which like elements may be labeled using like reference numerals in the various figures, illustrating embodiments of the invention.

DETAILED DESCRIPTION

Figure 1:
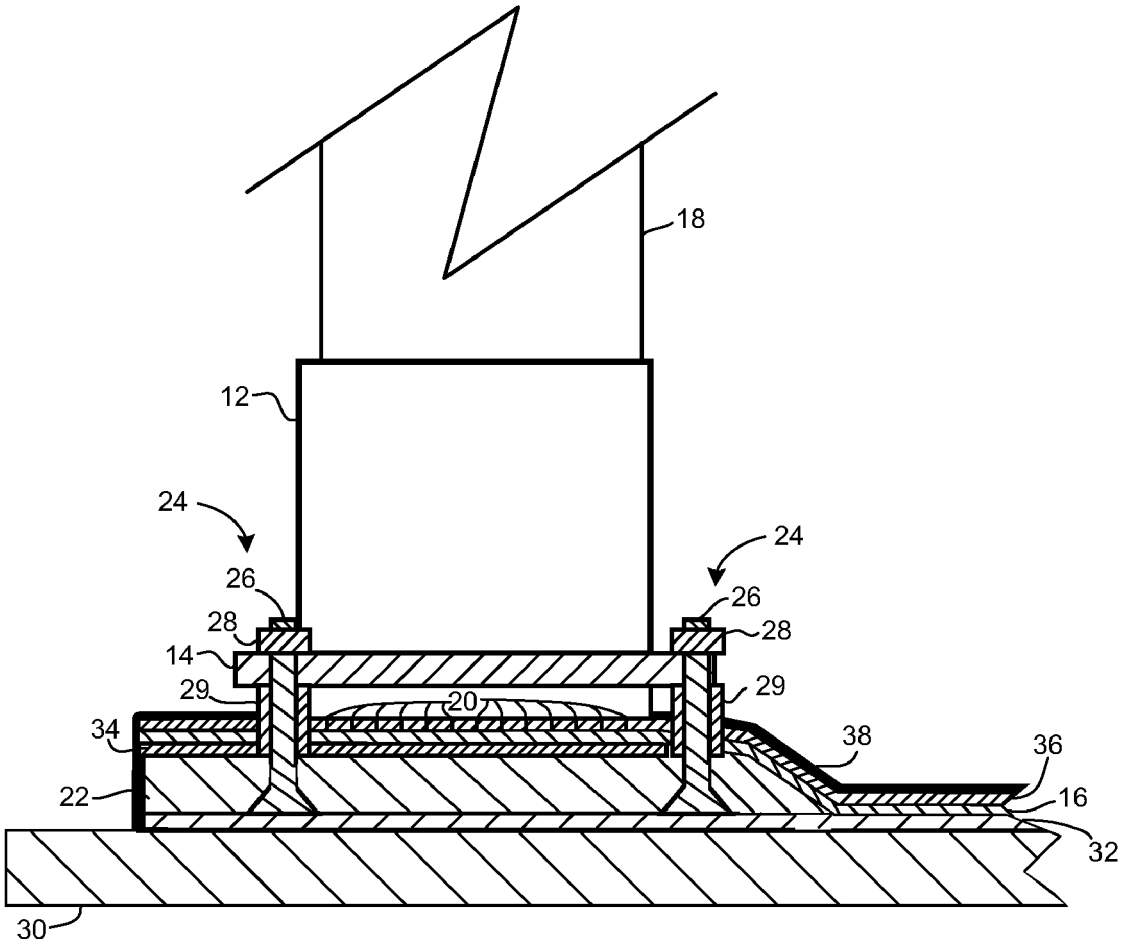
FIG. 1 is a sectioned illustration of a first embodiment of the described apparatus arranged in an installed orientation.

FIG. 1 is a sectioned illustration of a first embodiment of the described apparatus arranged in an installed orientation. In FIG. 1, an interconductor connecting apparatus 10 may include an electrical connecting structure 12 and a fastening structure 14. Fastening structure 14 may be fixedly associated with electrical connecting structure 12, fastening structure 14 may be integrally formed with electrical connecting structure 12 or fastening structure 14 and electrical connecting structure 12 may be embodied in unitary structure in some other manner.

A flat conductor member 16 may support at least one first electrical conductor in a manner known to one skilled in the art of electrical wiring installation. A second conductor member 18 may support at least one second conductor in a manner known to one skilled in the art of electrical wiring installation. Second conductor member 18 may be embodied in a substantially cylindrical cable configured for insertion into a generally cylindrical electrical connection structure 12, as illustrated in FIG. 1. Alternatively, second electrical conductor member 18 may be configured in a non-cylindrical shape with a differently-shaped electrical connection structure 12 and remain within the scope of this disclosure. By way of example and not by way of limitation, second electrical conductor member 18 may be a second flat wire conductor member and electrical connection structure 12 may be a flat-wire connection structure.

Electrical connection structure 12 may present a plurality of connecting pin structures 20 for effecting electrical connection between electrical conductors supported in flat conductor member 16 and second electrical conductor member 18, in a manner known to those skilled in the art of electrical wiring installation.

A support structure 22 may be situated and configured for supporting flat conductor member 16. Support structure 22 may be inflexible. Electrical connection structure 12 and flat conductor member 16 may each have generally equal widths in a plane substantially perpendicular with the plane of FIG. 1. Electrical connection structure 12 may extend a first length and flat conductor member 16 may extend a second length substantially within the plane of FIG. 1. The second length may be greater than the first length, as indicated in FIG. 1. Support structure 22 may have a width generally coextensive with widths of electrical connection structure 12 and flat conductor member 16. Support structure 22 may have a third length greater than the second length of electrical connection structure 12 and less than the first length of flat conductor member 16.

Connecting members 24 may be configured for traversing flat conductor member 16 and interacting with at least one of fastening structure 14 and support structure 22 to capture flat conductor member 16 between electrical connecting structure 12 and support structure 22 in the installed orientation illustrated in FIG. 1.

Connecting members 24 may each be embodied in a threaded fastener 26 configured for passing through support structure 22, through flat conductor member 16 and through fastening structure 14 for threaded engagement with nut members 28. Bushing members 29 may surround threaded fasteners 26 substantially where threaded fasteners 26 traverse flat conductor member 16. Threaded fasteners 26 may be countersunk within support structure 22 to present a substantially planar face for resting upon or may be affixed to a generally planar-faced host structure 30. Host structure 30 may include, by way of example and not by way of limitation, an aircraft structural piece such as a fuselage.

An adhesive layer 32 may be situated between support structure 22 and host structure 30. An electrically insulating layer 34 may be situated between flat conductor member 16 and support structure 22. An adhesive or sealant layer 36 may be situated upon flat conductor member 16 and extend between flat conductor member 16 and electrical connection structure 12. If adhesive or sealant layer 36 may be installed, connecting pins structures 20 may pierce adhesive or sealant layer 36 to effect electrical connection with first conductors supported in flat conductor member 16 (not shown in detail in FIG. 1). A paint layer 38 may overlay adhesive or sealant layer 36, flat conductor member 16, electrically insulating layer 34, support structure 22 and adhesive layer 32. If any of paint layer 38, adhesive or sealant layer 36, electrically insulating layer 34 or adhesive layer 32 may be included in interconductor apparatus 10, threaded fasteners 26 may also traverse those installed elements in establishing the installed orientation illustrated in FIG. 1.

Mechanical loads from electrical connection structure 12 may be transmitted through the relatively stiff bolted interface between fastening structure 14 via connecting members 24 to support structure 22. The mechanical loads may not pass through connecting pin structure 20 so that minimal mechanical load may be transmitted from electrical connecting structure 12 load to the electrical connection between flat conductor member 16 and second conductor member 18. Further, no additional support such as a mechanical attachment to a connection box or other enclosure may be necessary to avoid transmitting mechanical loads to the electrical connection between flat conductor member 16 and second conductor member 18.

Figure 2:
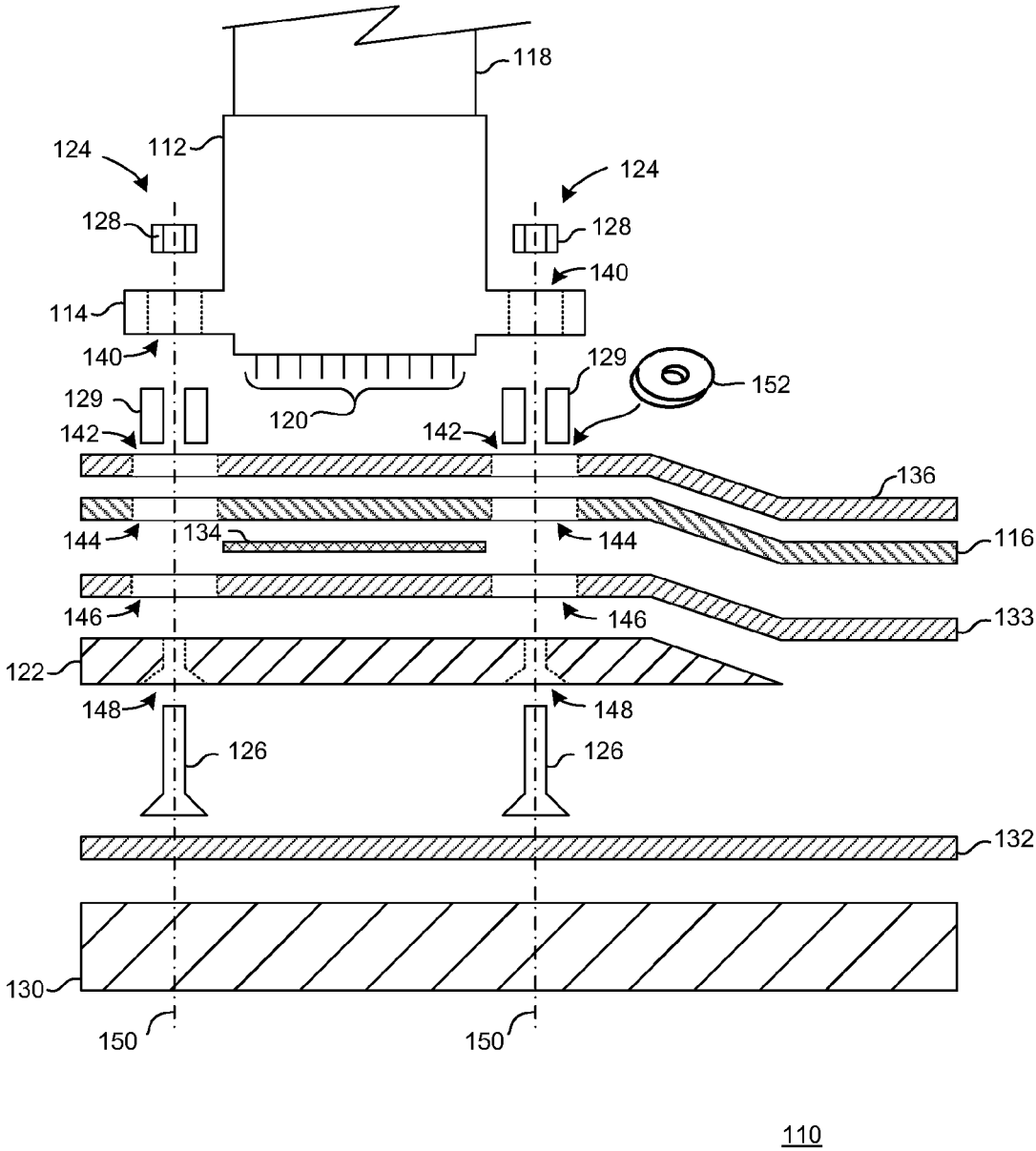
FIG. 2 is an exploded sectioned illustration of an embodiment of the apparatus.

FIG. 2 is an exploded sectioned illustration of an embodiment of the apparatus. In FIG. 2, an interconductor connecting apparatus 110 may include an electrical connecting structure 112 and a fastening structure 114. Fastening structure 114 may be fixedly associated with electrical connecting structure 112, fastening structure 114 may be integrally formed with electrical connecting structure 112 or fastening structure 114 and electrical connecting structure 112 may be embodied in unitary structure in some other manner.

A flat conductor member 116 may support at least one first electrical conductor in a manner known to one skilled in the art of electrical wiring installation. A second conductor member 118 may support at least one second conductor in a manner known to one skilled in the art of electrical wiring installation. Second conductor member 118 may be embodied in a substantially cylindrical cable configured for insertion into a generally cylindrical electrical connection structure 112, as illustrated in FIG. 2. Alternatively, second electrical conductor member 118 may be configured in a non-cylindrical shape with a differently-shaped electrical connection structure 112 and remain within the scope of this disclosure. By way of example and not by way of limitation, second electrical conductor member 118 may be a second flat wire conductor member and electrical connection structure 112 may be a flat-wire connection structure.

Electrical connection structure 112 may present a plurality of connecting pin structures 120 for effecting electrical connection between electrical conductors supported in flat conductor member 116 and second electrical conductor member 118, in a manner known to those skilled in the art of electrical wiring installation.

A support structure 122 may be situated and configured for supporting flat conductor member 116. Support structure 122 may be inflexible. Electrical connection structure 112 and flat conductor member 116 may each have generally equal widths in a plane substantially perpendicular with the plane of FIG. 2. Electrical connection structure 112 may extend a first length and flat conductor member 116 may extend a second length substantially within the plane of FIG. 2. The second length may be greater than the first length, as indicated in FIG. 2. Support structure 122 may have a width generally coextensive with widths of electrical connection structure 112 and flat conductor member 116. Support structure 122 may have a third length greater than the second length of electrical connection structure 112 and less than the first length of flat conductor member 116.

Connecting members 124 may be configured for traversing flat conductor member 116 and interacting with at least one of fastening structure 114 and support structure 122 to capture flat conductor member 116 between electrical connecting structure 112 and support structure 122 in an installed orientation (see FIG. 1).

Connecting members 124 may each be embodied in a threaded fastener 126 configured for passing through countersunk apertures 148 in support structure 122, through apertures 144 in flat conductor member 116 and through apertures 140 in fastening structure 114 for threaded engagement with nut members 128. Bushing members 129 may surround threaded fasteners 126 substantially within apertures 144 via which threaded fasteners 126 traverse flat conductor member 116. Bushing members 129 may be compressible or non-compressible. Countersunk apertures 148 may be provided for receiving threaded fasteners 126 within support structure 122 in order to present a substantially planar face for resting upon or may be affixed to a generally planar-faced host structure 130 in an installed orientation (see FIG. 1). Host structure 130 may include, by way of example and not by way of limitation, an aircraft structural piece such as a fuselage.

An adhesive layer 132 may be situated between support structure 122 and host structure 130. An electrically insulating layer 134 may be situated between flat conductor member 116 and support structure 122 generally between threaded fasteners 126 in an installed orientation (see FIG. 1). Alternatively, electrically insulating layer 134 may extend beyond threaded fasteners 126 (see FIG. 3). An adhesive or sealant layer 136 may be situated upon flat conductor member 116 and extend between flat conductor member 116 and electrical connection structure 112. If adhesive or sealant layer 136 may be installed, connecting pins structures 120 may pierce adhesive or sealant layer 136 to effect electrical connection with first conductors supported in flat conductor member 116 (not shown in detail in FIG. 2). If adhesive or sealant layer 136 may be included in interconductor apparatus 110, apertures 142 may be provided to accommodate traversal by bushing members 129 and threaded fasteners 126. An additional adhesive layer 133 may be provided between electrically insulating layer 134 and support structure 122. If additional adhesive layer 133 may be included in interconductor apparatus 110, apertures 146 may be provided to accommodate traversal by bushing members 129 and threaded fasteners 126. Apertures 140, 142, 144, 146 148 may be oriented substantially coaxially about axes 150 in an installed orientation.

A reinforcing member 152 configured generally as a grommet or similar structure may be provided within at least one of apertures 140, 142, 144, 146 148 for reinforcement in an installed orientation (see FIG. 1). When installed, reinforcing member 152 may surround bushing member 129. Reinforcing member 152 may be compressible or non-compressible.

Figure 3:
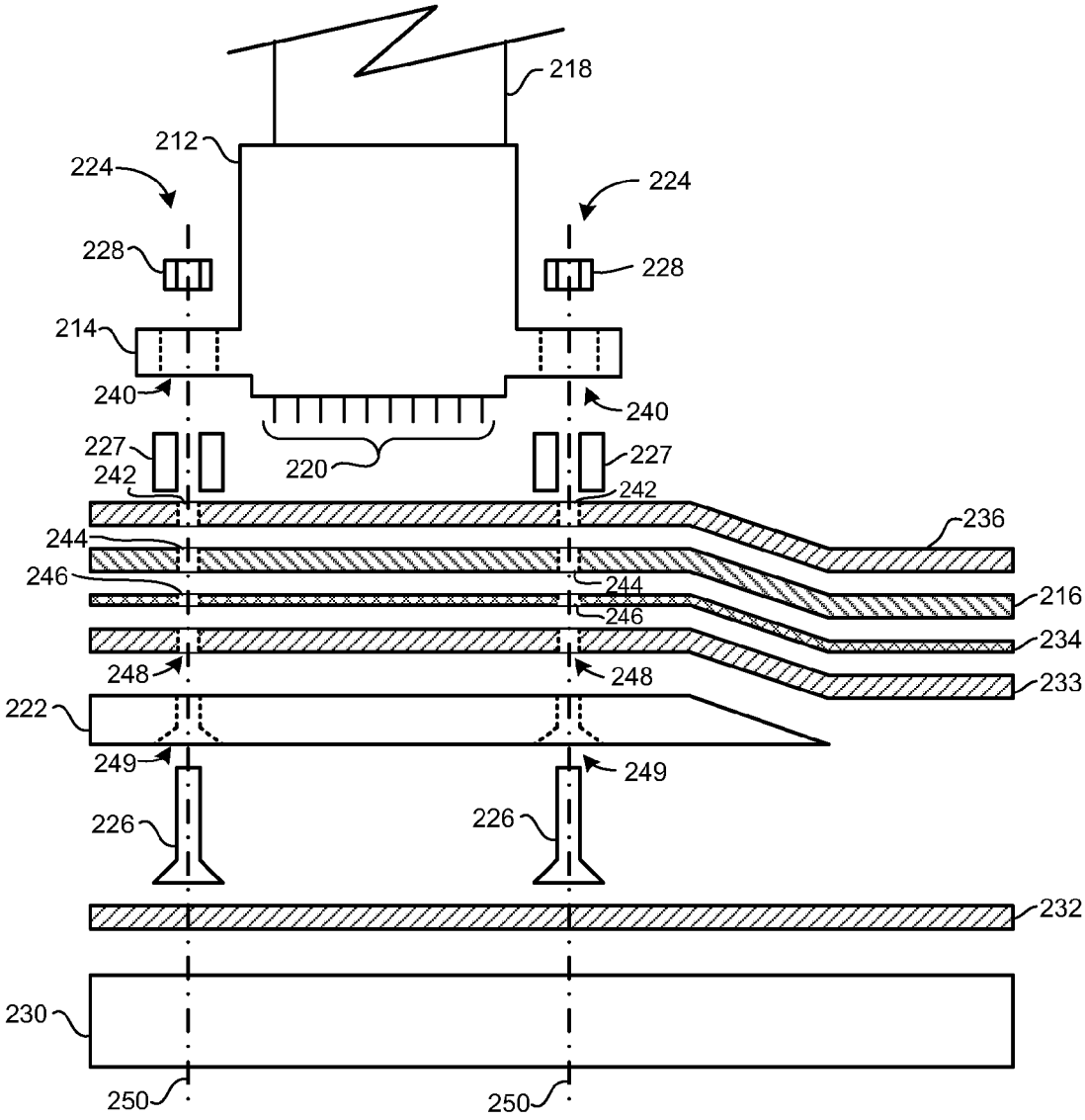
FIG. 3 is an exploded sectioned illustration of an alternate embodiment of the disclosed apparatus.

FIG. 3 is an exploded sectioned illustration of an alternate embodiment of the disclosed apparatus. In FIG. 3, an interconductor connecting apparatus 210 may include an electrical connecting structure 212 and a fastening structure 214. Fastening structure 214 may be fixedly associated with electrical connecting structure 212, fastening structure 214 may be integrally formed with electrical connecting structure 212 or fastening structure 214 and electrical connecting structure 212 may be embodied in unitary structure in some other manner.

A flat conductor member 216 may support at least one first electrical conductor in a manner known to one skilled in the art of electrical wiring installation. A second conductor member 218 may support at least one second conductor in a manner known to one skilled in the art of electrical wiring installation. Second conductor member 218 may be embodied in a substantially cylindrical cable configured for insertion into a generally cylindrical electrical connection structure 212, as illustrated in FIG. 3. Alternatively, second electrical conductor member 218 may be configured in a non-cylindrical shape with a differently-shaped electrical connection structure 212 and remain within the scope of this disclosure. By way of example and not by way of limitation, second electrical conductor member 218 may be a second flat wire conductor member and electrical connection structure 212 may be a flat-wire connection structure.

Electrical connection structure 212 may present a plurality of connecting pin structures 220 for effecting electrical connection between electrical conductors supported in flat conductor member 216 and second electrical conductor member 218, in a manner known to those skilled in the art of electrical wiring installation.

A support structure 222 may be situated and configured for supporting flat conductor member 216. Support structure 222 may be inflexible. Electrical connection structure 212 and flat conductor member 216 may each have generally equal widths in a plane substantially perpendicular with the plane of FIG. 3. Electrical connection structure 212 may extend a first length and flat conductor member 216 may extend a second length substantially within the plane of FIG. 3. The second length may be greater than the first length, as indicated in FIG. 3. Support structure 222 may have a width generally coextensive with widths of electrical connection structure 212 and flat conductor member 216. Support structure 222 may have a third length greater than the second length of electrical connection structure 212 and less than the first length of flat conductor member 216.

Connecting members 224 may be configured for traversing flat conductor member 216 and interacting with at least one of fastening structure 214 and support structure 222 to capture flat conductor member 216 between electrical connecting structure 212 and support structure 222 in an installed orientation (see FIG. 1).

Connecting members 224 may each be embodied in a threaded fastener 226 configured for passing through countersunk apertures 248 in support structure 222, through apertures 244 in flat conductor member 216 and through apertures 240 in fastening structure 214 for threaded engagement with nut members 228. Spacer members 227 may surround threaded fasteners 226 between fastening structure 214 and an upper layer of apparatus 210, such as flat conductor member 216 or, if installed, an adhesive or sealant layer 236. Threaded fasteners 226 may traverse flat conductor member 216 via apertures 244. Countersunk apertures 249 may be provided for receiving threaded fasteners 226 within support structure 222 in order to present a substantially planar face for resting upon or may be affixed to a generally planar-faced host structure 230 in an installed orientation (see FIG. 1). Host structure 230 may include, by way of example and not by way of limitation, an aircraft structural piece such as a fuselage.

An adhesive layer 232 may be situated between support structure 222 and host structure 230. An electrically insulating layer 234 may be situated between flat conductor member 216 and support structure 222 and may be generally coextensive with flat conductor member 216, for at least a portion of the length of flat conductor member 216. If electrically insulating layer 234 may be included in interconductor apparatus 210, apertures 246 may be provided to accommodate traversal by threaded fasteners 226. An adhesive or sealant layer 236 may be situated upon flat conductor member 216 and extend between flat conductor member 216 and electrical connection structure 212. If adhesive or sealant layer 236 may be installed, connecting pins structures 220 may pierce adhesive or sealant layer 236 to effect electrical connection with first conductors supported in flat conductor member 216 (not shown in detail in FIG. 3). If adhesive or sealant layer 236 may be included in interconductor apparatus 210, apertures 242 may be provided to accommodate traversal by threaded fasteners 126. An additional adhesive layer 233 may be provided between electrically insulating layer 234 and support structure 222. If additional adhesive layer 233 may be included in interconductor apparatus 210, apertures 248 may be provided to accommodate traversal by threaded fasteners 226. Apertures 240, 242, 244, 246, 248, 249 may be oriented substantially coaxially about axes 250 in an installed orientation.

Figure 4:
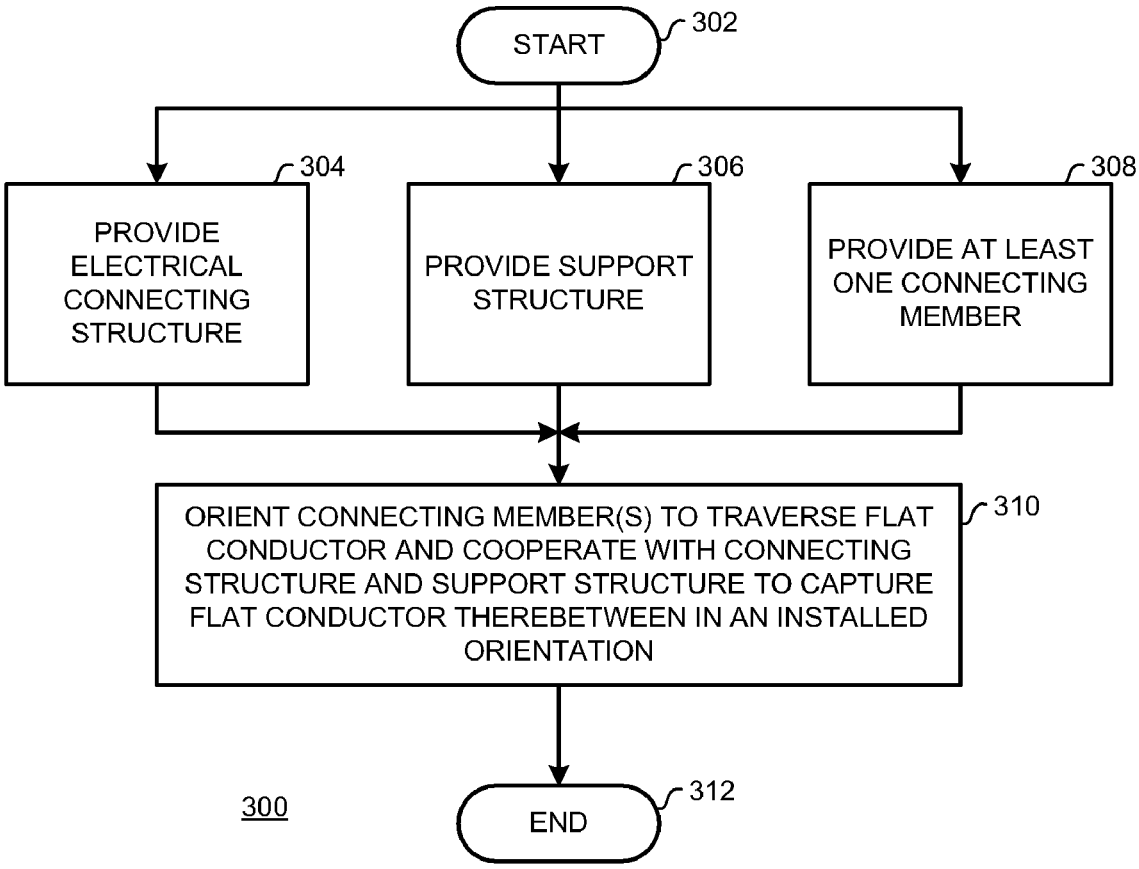
FIG. 4 is a flow chart illustrating the described method.

FIG. 4 is a flow chart illustrating the described method. In FIG. 4, a method 300 for establishing a substantially unitary connecting structure including a generally flat conductor member carrying a first plurality of first electrical conductors and a second conductor member carrying a second plurality of second electrical conductors may begin at a START locus 302. Method 300 may continue by, in no particular order: (1) providing an electrical connecting structure configured for receiving the second conductor member to establish electrical connection between at least one first electrical conductor of the first plurality of first electrical conductors and at least one second electrical conductor of the second plurality of second electrical conductors, as indicated by a block 304; (2) providing a generally inflexible support structure, as indicated by a block 306; and (3) providing at least one connecting member, as indicated by a block 308.

Method 300 may continue with orienting the at least one connecting member to traverse the flat conductor member and to cooperate with the electrical connecting structure and the support structure to effect capturing the flat conductor member between the connecting structure and the support structure in an installed orientation, as indicated by a block 310. Method 300 may terminate at an END locus 312.

It is to be understood that, while the detailed drawings and specific examples given describe embodiments of the invention, they are for the purpose of illustration only, that the apparatus and method of the embodiments of the invention are not limited to the precise details and conditions disclosed and that various changes may be made therein without departing from the spirit of embodiments of the invention which is defined by the following claims:

We claim:

1. An apparatus for effecting interconductor connecting between a generally flat conductor member supporting at least one first electrical conductor and a second conductor member supporting at least one second electrical conductor; the apparatus comprising:

(a) an electrical connecting structure configured for receiving said second conductor member to effect establishing electrical connection between at least one said at least one first electrical conductor and at least one said at least one second electrical conductor in an installed orientation; said flat conductor member being oriented substantially symmetrically with respect to a plane; said electrical connecting structure receiving said second conductor member oriented substantially symmetrically with respect to an axis; said axis intersecting said plane at an angle;

(b) a fastening structure fixedly associated with said electrical connecting structure;

(c) a support structure configured for orienting said flat conductor member substantially in at least a first support plane and a second support plane generally parallel with said plane; and (d) at least one connecting member configured for traversing said flat conductor member for effecting interaction between said support structure and said fastening structure for capturing said flat conductor member between said support structure and said electrical connecting structure in said installed orientation.

2. An apparatus for effecting interconductor connecting between a generally flat conductor member supporting at least one first electrical conductor and a second conductor member supporting at least one second electrical conductor as recited in claim 1 wherein said angle is substantially between forty-five degrees and ninety degrees.

3. An apparatus for effecting interconductor connecting between a generally flat conductor member supporting at least one first electrical conductor and a second conductor member supporting at least one second electrical conductor as recited in claim 1 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

4. An apparatus for effecting interconductor connecting between a generally flat conductor member supporting at least one first electrical conductor and a second conductor member supporting at least one second electrical conductor as recited in claim 1 wherein said at least one connecting member comprises a plurality of threaded fasteners and wherein said flat conductor member presents a plurality of apertures appropriately oriented and proportioned for permitting said plurality of threaded fasteners to pass through said flat conductor member in said installed orientation.

5. An apparatus for effecting interconductor connecting between a generally flat conductor member supporting at least one first electrical conductor and a second conductor member supporting at least one second electrical conductor as recited in claim 1 wherein said electrical connecting structure and said fastening structure are embodied in an integral structure.

6. An apparatus for effecting interconductor connecting between a generally flat conductor member supporting at least one first electrical conductor and a second conductor member supporting at least one second electrical conductor; the apparatus comprising:

(a) an electrical connecting structure configured for receiving said second conductor member to effect establishing electrical connection between at least one said at least one first electrical conductor and at least one said at least one second electrical conductor in an installed orientation;

(b) a fastening structure fixedly associated with said electrical connecting structure;

(c) a support structure configured for orienting said flat conductor member substantially in at least a first support plane and a second support plane; said first support plane and said second support plane being generally parallel; and (d) at least one connecting member configured for traversing said flat conductor member for effecting interaction between said support structure and said fastening structure for capturing said flat conductor member between said support structure and said electrical connecting structure in said installed orientation; said at least one connecting member comprising a plurality of threaded fasteners; said flat conductor member presenting a plurality of apertures appropriately oriented and proportioned for permitting said plurality of threaded fasteners to pass through said flat conductor member in said installed orientation; said at least one connecting member further comprising a respective spacer member encircling at least one respective threaded fastener of said plurality of threaded fasteners; said respective spacer member urging said flat conductor member toward said support structure in said installed orientation.

7. An apparatus for effecting interconductor connecting between a generally flat conductor member supporting at least one first electrical conductor and a second conductor member supporting at least one second electrical conductor as recited in claim 2 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

8. An apparatus for effecting interconductor connecting between a generally flat conductor member supporting at least one first electrical conductor and a second conductor member supporting at least one second electrical conductor as recited in claim 7 wherein said electrical connecting structure and said fastening structure are embodied in an integral structure.

9. An apparatus for establishing a substantially unitary connecting structure including a generally flat conductor member carrying a first plurality of first electrical conductors and a second conductor member carrying a second plurality of second electrical conductors; the apparatus comprising:

(a) an electrical connecting structure configured for receiving said second conductor member to establish electrical connection between at least one first electrical conductor of said first plurality of first electrical conductors and at least one second electrical conductor of said second plurality of second electrical conductors; said generally flat conductor member being oriented substantially symmetrically with respect to a plane; said electrical connecting structure receiving said second conductor member oriented substantially symmetrically with respect to an axis; said axis intersecting said plane at an angle;

(b) a generally inflexible support structure orienting said flat conductor member substantially in at least a first support plane and a second support plane generally parallel with said plane; and (c) at least one connecting member traversing said flat conductor member and cooperating with said electrical connecting structure and said support structure for capturing said flat conductor member between said connecting structure and said support structure in an installed orientation.

10. An apparatus for establishing a substantially unitary connecting structure including a generally flat conductor member carrying a first plurality of first electrical conductors and a second conductor member carrying a second plurality of second electrical conductors as recited in claim 9 wherein said angle is substantially between forty-five degrees and ninety degrees.

11. An apparatus for establishing a substantially unitary connecting structure including a generally flat conductor member carrying a first plurality of first electrical conductors and a second conductor member carrying a second plurality of second electrical conductors as recited in claim 9 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

12. An apparatus for establishing a substantially unitary connecting structure including a generally flat conductor member carrying a first plurality of first electrical conductors and a second conductor member carrying a second plurality of second electrical conductors as recited in claim 9 wherein said at least one connecting member comprises a plurality of threaded fasteners and wherein said flat conductor member presents a plurality of apertures appropriately oriented and proportioned for permitting said plurality of threaded fasteners to pass through said flat conductor member in said installed orientation.

13. An apparatus for establishing a substantially unitary connecting structure including a generally flat conductor member carrying a first plurality of first electrical conductors and a second conductor member carrying a second plurality of second electrical conductors as recited in claim 10 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

14. An apparatus for establishing a substantially unitary connecting structure including a generally flat conductor member carrying a first plurality of first electrical conductors and a second conductor member carrying a second plurality of second electrical conductors; the apparatus comprising:

(a) an electrical connecting structure configured for receiving said second conductor member to establish electrical connection between at least one first electrical conductor of said first plurality of first electrical conductors and at least one second electrical conductor of said second plurality of second electrical conductors;

(b) a generally inflexible support structure orienting said flat conductor member substantially in at least a first support plane and a second support plane generally parallel with said plane; and (c) at least one connecting member traversing said flat conductor member and cooperating with said electrical connecting structure and said support structure for capturing said flat conductor member between said connecting structure and said support structure in an installed orientation; said at least one connecting member comprising a plurality of threaded fasteners; said flat conductor member presenting a plurality of apertures appropriately oriented and proportioned for permitting said plurality of threaded fasteners to pass through said flat conductor member in said installed orientation; said at least one connecting member further comprising a respective spacer member encircling at least one respective threaded fastener of said plurality of threaded fasteners; said respective spacer member urging said flat conductor member toward said support structure in said installed orientation.

15. A method for establishing a substantially unitary connecting structure including a generally flat conductor member carrying a first plurality of first electrical conductors and a second conductor member carrying a second plurality of second electrical conductors; the method comprising:

(a) in no particular order:

(1) providing an electrical connecting structure configured for receiving said second conductor member to establish electrical connection between at least one first electrical conductor of said first plurality of first electrical conductors and at least one second electrical conductor of said second plurality of second electrical conductors; said generally flat conductor member being oriented substantially symmetrically with respect to a plane; said electrical connecting structure receiving said second conductor member oriented substantially symmetrically with respect to an axis; said axis intersecting said plane at an angle;

(2) providing a generally inflexible support structure orienting said flat conductor member substantially in at least a first support plane and a second support plane generally parallel with said plane; and (3) providing at least one connecting member; and (b) orienting said at least one connecting member to traverse said flat conductor member and to cooperate with said electrical connecting structure and said support structure to effect capturing said flat conductor member between said connecting structure and said support structure in an installed orientation.

16. A method for establishing a substantially unitary connecting structure including a generally flat conductor member carrying a first plurality of first electrical conductors and a second conductor member carrying a second plurality of second electrical conductors as recited in claim 15 wherein said angle is substantially between forty-five and ninety degrees.

17. A method for establishing a substantially unitary connecting structure including a generally flat conductor member carrying a first plurality of first electrical conductors and a second conductor member carrying a second plurality of second electrical conductors as recited in claim 15 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

18. A method for establishing a substantially unitary connecting structure including a generally flat conductor member carrying a first plurality of first electrical conductors and a second conductor member carrying a second plurality of second electrical conductors as recited in claim 15 wherein said at least one connecting member comprises a plurality of threaded fasteners and wherein said flat conductor member presents a plurality of apertures appropriately oriented and proportioned for permitting said plurality of threaded fasteners to pass through said flat conductor member in said installed orientation.

19. A method for establishing a substantially unitary connecting structure including a generally flat conductor member carrying a first plurality of first electrical conductors and a second conductor member carrying a second plurality of second electrical conductors as recited in claim 16 wherein additional material layers are presented between said support structure and said connecting structure in said installed orientation, and wherein said additional material layers include an adhesive sealant material layer between said flat conductor member and said connecting structure and include at least one of an electrical insulating material layer and an adhesive material layer between said flat conductor member and said support structure.

20. A method for establishing a substantially unitary connecting structure including a generally flat conductor member carrying a first plurality of first electrical conductors and a second conductor member carrying a second plurality of second electrical conductors; the method comprising:

(a) in no particular order:

(1) providing an electrical connecting structure configured for receiving said second conductor member to establish electrical connection between at least one first electrical conductor of said first plurality of first electrical conductors and at least one second electrical conductor of said second plurality of second electrical conductors;

(2) providing a generally inflexible support structure orienting said flat conductor member substantially in at least a first support plane and a second support plane generally parallel with said plane; and (3) providing at least one connecting member; and (b) orienting said at least one connecting member to traverse said flat conductor member and to cooperate with said electrical connecting structure and said support structure to effect capturing said flat conductor member between said connecting structure and said support structure in an installed orientation; said at least one connecting member comprising a plurality of threaded fasteners; said flat conductor member presenting a plurality of apertures appropriately oriented and proportioned for permitting said plurality of threaded fasteners to pass through said flat conductor member in said installed orientation; said at least one connecting member further comprising a respective spacer member encircling at least one respective threaded fastener of said plurality of threaded fasteners; said respective spacer member urging said flat conductor member toward said support structure in said installed orientation.

* * * * *